United States Patent [19]

Luban

[11] 4,080,899

[45] Mar. 28, 1978

[54] LIGHT REFLECTIVE SHOT PELLETS

[76] Inventor: William L. Luban, 8133 Alabama Ave., Clarendon Hills, Ill. 60514

[21] Appl. No.: 752,442

[22] Filed: Dec. 20, 1976

[51] Int. Cl.[2] ..... F42B 7/04

[52] U.S. Cl. ..... 102/42 R; 102/87

[58] Field of Search ..... 102/42 R, 42 C, 60, 102/87

[56] References Cited

U.S. PATENT DOCUMENTS

| | | | |
|---|---|---|---|
| 1,304,962 | 5/1919 | Gravely | 102/87 |
| 2,772,634 | 12/1956 | Oberfell | 102/42 R |
| 2,919,647 | 1/1960 | Dear et al. | 102/42 R |
| 3,262,390 | 7/1966 | Cowles et al. | 102/42 C |
| 3,363,561 | 1/1968 | Irons | 102/42 R |

*Primary Examiner*—Verlin R. Pendegrass
*Attorney, Agent, or Firm*—Norman Lettvin

[57] ABSTRACT

Shot pellets for a shotgun cartridge are encapsulated with light reflective coatings. The reflective coatings permit nighttime tracking of the shot pellets'trajectory to the target situs. A thin, lubricant film prevents adhesion between coated pellets when they are tightly packed in the shot chamber of the cartridge. A protective, plastic liner surrounds the shot pellets in the shot chamber and moves with the pellets from the barrel of the shotgun to prevent frictional erosion of the shot pellets and fouling of the barrel.

3 Claims, 2 Drawing Figures

LIGHT REFLECTIVE SHOT PELLETS

FIELD OF THE INVENTION

This invention relates to tracer pellets for shotgun cartridges and more particularly to light reflective coatings applied to the individual shot pellets to permit tracing at illuminated skeet shooting ranges.

BACKGROUND OF THE INVENTION

Skeet shooting has long been a popular sport. Recently, night skeet ranges have appeared. Even though the ranges are illuminated, the skeet shooting enthusiast finds the lighting insufficient to perceive the flight of his pellets as they progress toward the moving target. There is no problem if the shooter hits the target, but for the purpose of correction, it is essential that he know whether he missed because he aimed too high, too low, too far to the right or too far to the left.

Prior art tracer elements have recognized the problem and attempted to solve it through the use of (1) pyrotechnic materials as shown by Stoner in U.S. Pat. No. 3,405,638 and Cowles et al in U.S. Pat. No. 3,262,390; (2) complicated retroreflective systems such as Bellinger's in U.S. Pat. No. 3,757,632; and (3) tedious pellet modifications as evidenced by Schmitt in U.S. Pat. No. 3,760,735.

These prior devices have proved dangerous, expensive or have failed to simulate the actual trajectory of shotgun pellets.

It is therefore an object of this invention to provide shot pellets for a shotgun cartridge which enable a nighttime skeet shooter to follow the trajectory of his shot pellets.

It is a further object of this invention to provide shot pellets for a shotgun cartridge that are encapsulated with light reflective coatings.

It is another object of this invention to provide shot pellets for a shotgun cartridge that are encapsulated with light reflective coatings and covered by thin lubricant films.

It is still a further object of this invention to provide a protective plastic liner surrounding the encapsulated and lubricant covered shot pellets.

Other objects and advantages of the invention will become clear from the following description of a preferred embodiment of the invention.

BRIEF SUMMARY OF THE INVENTION

The shot pellets of the present invention are encapsulated with white, light reflective coatings which permit nighttime tracking of the shot pellets' trajectory to the target situs at illuminated target ranges. A thin lubricant film covers the shot pellets and prevents adhesion between coated pellets in the shot chamber of the cartridge. A protective, plastic liner surrounds the shot pellets in the shot chamber and is discharged with the shot pellets from the barrel of the shotgun to prevent frictional erosion of the pellets and fouling of the barrel.

DESCRIPTION OF THE PREFERRED EMBODIMENT

Figure 1:
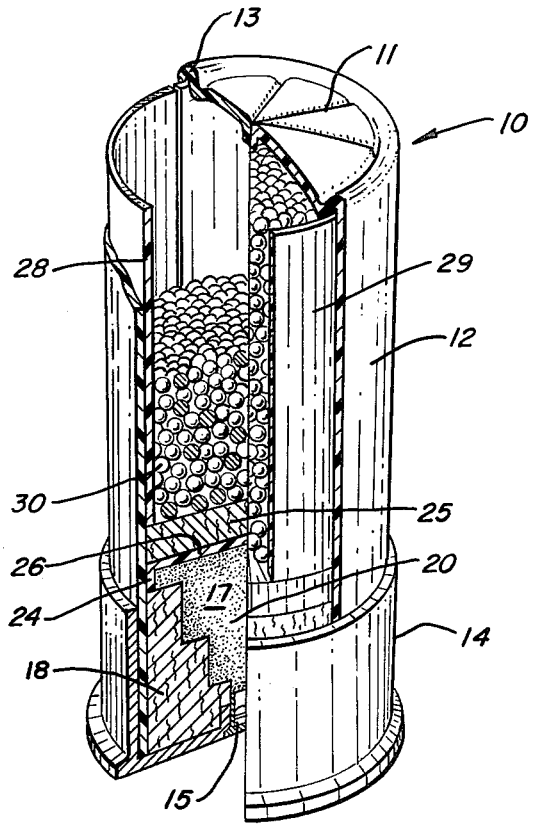
FIG. 1 is a perspective view, partially cut away, of a shotgun cartridge embodying the present invention and showing the shot pellets and liner positioned in the cartridge.

A preferred form of the shotgun cartridge, according to the invention, is illustrated in FIG. 1 of the drawings. The cartridge is identified generally by the reference numeral 10. Cartridge 10 is similar to many commonly employed shells. It has a casing 12 which may be of plastic and a metal base 14 which may be of brass. The base 14 may be crimped to secure the base 14 to the casing 12. The upper end of the casing 12 of the cartridge is provided with an integral closure 13 which is formed by infolding the end of the casing. By first slitting or cutting the end into pie shaped pieces 11, detonation of the primer cap will easily open the end along the slits to permit pellet discharge.

Detonation means in the form of a primer cap 15, is inserted in metal base 14, at the center axis thereof, and is adapted to be struck and exploded by the firing pin of the shotgun.

Within the base portion of the casing 12 is a hollow gun powder chamber 17. Gun powder 20 fills that portion of the hollow chamber 17 not occupied by filler wab 18.

A piston 25 occupies the space immediately above the gun powder chamber 17. Piston 25 includes base plate 26 and peripheral, annular skirt 24. Upon detonation the ends of skirt 24 are forced outwardly to bear first against the casing 12 and then against the barrel to prevent a loss of gas between the barrel and the piston. The hollow, upper portion of casing 12 houses a protective, plastic liner 28. The liner 28 is formed from sheet material and rolled into tubular form for insertion into the shotgun cartridge 10. The liner 28 includes a plurality of longitudinal slits 29 and surrounds the shot pellets 30 which fill the upper portion of casing 12. This upper casing portion forms a shot pellet chamber 32.

Figure 2:
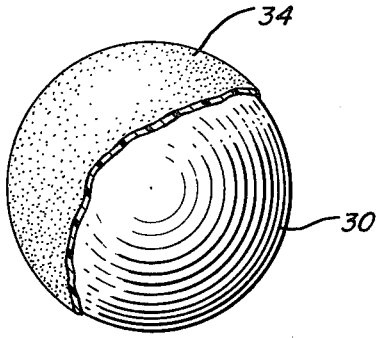
FIG. 2 is a perspective view of a shot pellet of the present invention with the light reflective coating partially removed.

Each pellet 30 is a small, generally spherical piece of lead and may range in diameter from 1/16 to ¼ of an inch. As easily seen in FIG. 2, each pellet 30 is a metal, generally spherical ball encapsulated with a white, durable coating 34 to render it light reflective and therefore visible for nighttime skeet shooting.

The coating is a water based product which dries very rapidly when applied in the preferred manner. In the preferred manner of application, the shot pellets are introduced into a barrel-like container tilted at an angle of twenty-five degrees from the horizontal. The barrel is then rotated at approximately 72 rpm. At this point, a forced hot air source (140°–160° F) is introduced and begins to warm the pellets. After 40 to 60 seconds, a small amount of coating is poured or sprayed onto the pellets. This coating dries within 45 seconds. The process is repeated until the shot pellets are completely covered with an even coat. They are dried for an additional two minutes after the barrel is stopped to cure the coating. A thin film of lubricant may then be sprayed on the shot pellets to prevent adhesion of adjacent pellets during storage in the tightly packed shot pellet chamber 32. The pellets are then heated for 12 to 15 minutes at a temperature of at least 200° F to complete the curing process.

The coating formula found to be most acceptable when economy, drying time, film strength and reflectivity are considered is the result of considerable experimentation. It was formed 30.0 percent from a pigment comprising 23.3 percent titanium dioxide (type III) and 6.7 percent silicates and 70.0 percent from a vehicle comprising 18.4 percent vinyl acetate acrylic resin and 51.6 percent volatile (water).

The coating forms a white, light reflective, encapsulating cover over shot pellets 30. The coating does not adhere to the smooth, peripheral surface of the pellet, but, rather is self-enclosing and forms a spherical casing surrounding the pellets. For best results, an additional twenty-four hours should be allowed for curing the pellets 30 before they are packed in the shot pellet chamber 32.

The usual manner of lighting a skeet shooting range places the lumination system behind the shooter and elevated to a height of 15 to 25 feet. The white reflective pellet coating enables the marksman to track the trajectory to the target situs even though the speed of the pellets is in the range of 1200 feet per second.

The protective plastic liner serves a variety of necessary functions. The liner moves out of the barrel of the shotgun along with the pellets upon detonation of the cartridge. This not only prevents fouling of the interior surface of the barrel through frictional, high-speed erosion of the pellet coating, but, also ensures that the pellets which would otherwise contact the barrel do not lose velocity and depart from their true flight path. If not for the liner, the friction between the barrel and the barrel contacting pellets would erode the coating and slow the pellet such that upon leaving the barrel, the barrel contacting shot pellets would assume their own trajectory at speeds reduced from the velocity of the inner, non-contacting pellets.

The liner quickly opens upon discharge from the barrel and falls to the ground ten to fifteen yards in front of the shooter. The coated pellets move freely toward the target.

The coating increases the size of the diameter of a shot pellet by about 10 percent. Therefore, the weight of a charge of coated pellets in a cartridge will be less than the weight of an uncoated charge of pellets in the cartridge. However, the normal trajectories of the coated or uncoated pellets will be remarkably similar over the normal effective pattern distance.

In operation, when the primer cap 15 is struck by the firing pin of the shotgun, the cap is exploded which in turn causes the charge of gun powder 20 to explode. The hot gases which are generated cause the piston 25 to project the protective liner 28 and shot pellets through the barrel of the shotgun and out into space. The liner opens and the pellets move quickly on their selected trajectory.

While one form of the invention has been described, it will be understood that the invention may be utilized in other forms and environments, so that the purpose of the appended claims is to cover all such forms of devices not disclosed but which embody the invention disclosed herein.

What I claim is:

1. Light reflective shot pellets for a shotgun cartridge including a tubular cartridge casing having a shot chamber, shot pellets in the shot chamber, and detonation means, the improvement comprising in combination:

a light reflective coating encapsulating the shot pellets to permit tracking of the pellets' trajectory to the target situs, the coating being the residue of a liquid mixture of which titanium dioxide is the principal light reflective element and with water being the principal vehicle of the liquid mixture prior to application to the shot pellets, a thin lubricant film coating the shot pellets to prevent adhesion between coated pellets, and a protective plastic liner surrounding the shot pellets in the shot chamber whereby detonation of the cartridge discharges the protective, plastic liner with the shot pellets from the barrel of the shotgun to prevent erosion of the coated pellets and fouling of the barrel.

2. The light reflective shot pellets of claim 1 wherein the reflective coating forms a spherical casing about but does no adhere to the shot pellets.

3. The light reflective shot pellets of claim 1 wherein the reflective coating is formed from a pigment of 23.3% titanium dioxide (type III), 6.7% silicates and a vehicle of 18.4% vinyl acetate acrylic resin, 51.6% water.

* * * * *